US005857927A

United States Patent [19]

Driscoll et al.

[11] Patent Number: 5,857,927

[45] Date of Patent: Jan. 12, 1999

[54] GOLF TEE PLACEMENT AND RETRIEVAL DEVICE

[76] Inventors: Robert E. Driscoll, 17 Wilson Ave., Torrington, Conn. 06790; Lori French, 38 Willow La., New Hartford, Conn. 06057

[21] Appl. No.: 4,723

[22] Filed: Jan. 8, 1998

[51] Int. Cl.[6] ..... A63B 57/00

[52] U.S. Cl. ..... 473/386; 473/284

[58] Field of Search ..... 473/386, 284, 473/286, 132; 294/19.1, 19.2

[56] References Cited

U.S. PATENT DOCUMENTS

| | | | |
|---|---|---|---|
| 1,902,682 | 3/1933 | Walrath | 473/386 |
| 2,609,198 | 9/1952 | Armstrong . | |
| 3,206,197 | 9/1965 | Miotke . | |
| 3,540,727 | 11/1970 | Hoe, Jr. | 473/386 |
| 3,889,946 | 6/1975 | Setecka . | |
| 4,313,604 | 2/1982 | Baxter | 473/386 |
| 4,466,650 | 8/1984 | Roedel . | |
| 4,526,369 | 7/1985 | Phelps . | |
| 4,714,250 | 12/1987 | Henthorn . | |
| 4,819,938 | 4/1989 | Hill . | |
| 4,951,947 | 8/1990 | Kopfle . | |
| 4,989,868 | 2/1991 | Manko | 473/386 |
| 5,310,177 | 5/1994 | Conrad et al. . | |
| 5,540,432 | 7/1996 | Keller . | |
| 5,718,646 | 2/1998 | Brewer | 473/386 |
| 5,772,533 | 6/1998 | Dahlmann | 473/386 |

*Primary Examiner*—Steven Wong
*Attorney, Agent, or Firm*—William C. Crutcher

[57] ABSTRACT

A tee placement and retrieval device is attached temporarily to a golf club handle by an elastomeric cup. The device has a container with a lateral slot for receiving a tee, a slot in an elastomeric retainer for temporarily holding the shank of the tee, and an off-center pressure member for driving the tee. The tee is retrieved by pulling the tee head with the retainer.

9 Claims, 2 Drawing Sheets

GOLF TEE PLACEMENT AND RETRIEVAL DEVICE

This invention relates generally to an accessory used in playing golf, and more particularly to an accessory which is useful in placing and retrieving a golf tee.

BACKGROUND OF THE INVENTION

The game of golf requires bending or stooping to insert a tee into the ground at the beginning of each hole, and then bending or stooping to retrieve the tee after driving the ball. Insertion of the golf tee sometimes requires considerable force because of the hardness of the ground. Older golfers or those with back problems have difficulty in bending or stooping to place and retrieve the tee. This has lead to a number of suggestions in the prior art for devices to place and retrieve the tee, without bending or stooping.

Tee placement devices are disclosed in a number of patents, of which the following are exemplary.

| Patent No. | Title | Inventor | Issue Date |
|---|---|---|---|
| 2,609,198 | Device for Setting Golf Balls and Tees | Armstrong | Sept. 2, 1952 |
| 3,206,197 | Golf Ball Tee Handling Tool | Miotke | Sept. 14, 1965 |
| 3,889,946 | Portable Adjustable Tee and Ball Positioning Device | Setecka | June 17, 1975 |
| 4,313,604 | Golf Tee and Ball Stick Device | Baxter | Feb. 2, 1982 |
| 4,466,650 | Golf Ball and Tee Handling Tool | Roedel | Aug. 21, 1984 |
| 4,526,369 | Golf Aid | Phelps | July 2, 1985 |
| 4,714,250 | Golf Ball and Tee Setter | Henthorn | Dec. 22,1 987 |
| 4,819,938 | Golf Ball and Tee Placement and Retrieval Tool | Hill | Apr. 11, 1989 |
| 4,951,947 | Golf Ball Teeing Device | Kopfle | Aug. 28, 1990 |
| 5,310,177 | No-Bend Golf Device | Conrad et al. | May 10, 1994 |
| 5,540,432 | Golf Tee and Ball Setter | Keller | July 30, 1996 |

Most of the aforementioned prior art involves a side insertion slot to laterally insert and temporarily hold the tee while it is located in the proper place on the ground, and means to press the top of the tee into the ground with force directed downward along the axis of the tee.

The aforementioned devices also are characterized by elongated handles attached to the tee driving tool, many having operating mechanisms extending through or along the elongated handle.

It would be desirable to have a tee placement and retrieval device which is simple in construction and does not require a permanently attached handle which has to be carried in the golf bag.

It would also be desirable to have a tee placement and retrieval device which is simple, requiring no moving parts and reliable in operation.

SUMMARY OF THE INVENTION

A golf tee placement and retrieval device for utilization with a separate elongated member to place and retrieve a golf tee having a circular head, a shank smaller in diameter than the head extending along an axis, and a tip, the device comprising a tee container having sidewall portions arranged to contain the tee head and a portion of the tee shank, the sidewall portions defining a tee insertion opening for laterally receiving the tee head and shank portion, a tee retainer disposed inside the sidewall portions, having yieldable portions defining a lateral slot communicating with the tee insertion opening, the lateral slot being of a width such that the yieldable portions yield to laterally receive and grip the tee shank portion to temporarily hold it in place in the tee container, a tee driver comprising a pressure member disposed in the tee container and adapted to contact the tee head at a location laterally offset from the tee shank axis on a side thereof toward the tee insertion opening, so as to force the tee shank away from the tee insertion opening as the tip of the tee is inserted, and temporary attachment means connected to the tee container and adapted for connection to the end of the elongated member.

DRAWINGS

The invention will be better understood by reference to the following description, taken in connection with the accompanying drawings, in which:

FIG. 1 is a front elevation view of our improved golf tee placement and retrieval device, FIG. 2 is a side elevation view, FIG. 3 is a side elevation view in cross section of the device omitting the temporary attachment member shown in FIGS. 1 and 2, FIG. 4 is a top view, FIG. 5 is a bottom view, FIG. 6 is a side elevation view, partly in section, of our golf tee placement and retrieval device temporarily attached to a golf club handle, FIG. 7 is a side elevation view of the device temporarily attached to a carrying rod, FIG. 8 is an enlarged elevation view, in cross section, illustrating the operation of the invention, FIG. 9 is a side elevation view, in cross section, showing a modified view of the invention, and FIG. 9*a* is a bottom plan view of the FIG. 9 modification.

DESCRIPTION OF THE PREFERRED EMBODIMENT

Figure 1:
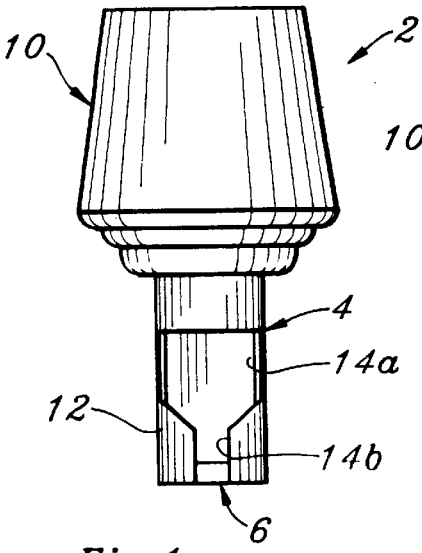
Figure 2:
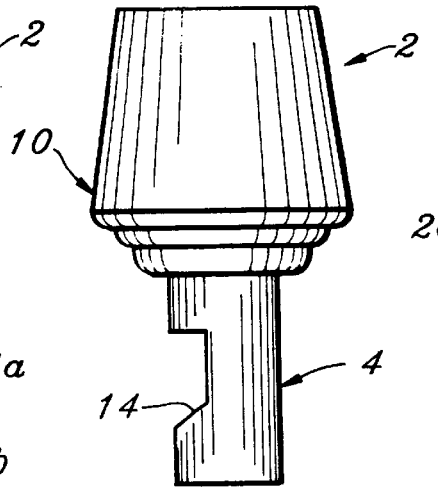
Figure 3:
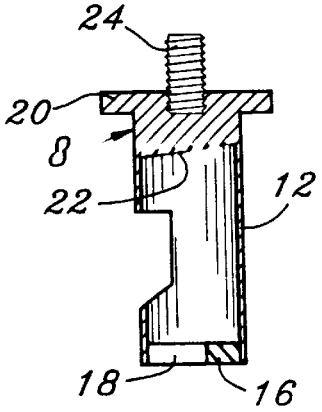

Referring now to FIGS. 1–5 of the drawing, an improved golf tee placement and retrieval device is shown generally at 2 comprising a tee container 4, a tee retainer 6, a tee driver 8 (FIG. 3), and an elastomeric cup 10 serving as temporary attachment means.

The tee container 4 is a cylindrical member with a circumferential sidewall 12. A tee insertion opening 14 is cut in the sidewall with a wide section 14*a* which will accommodate the head of a tee and a narrow section 14*b* which will accommodate the shank of a tee when it is inserted laterally into the tee container.

In order to retain the tee temporarily, the tee retainer 6 comprises a yieldable insert 16 with a lateral slot 18 cut in the insert and having an opening aligned with the shank entry opening 14*b*.

Closing off the upper end of the tee container 4 is a tee driver 8 comprising a support flange 20 and a pressure member 22. In accordance with one aspect of the present invention, the pressure member 22 is a flat surface inclined with respect to the axis of the tee holder, with the lowest side of the inclined surface disposed laterally on the side of the tee container axis on which is located the tee insertion opening 14 and the opening of the lateral slot 18.

A threaded member 24 is connected to extend from the center of flange 20 extending along the tee holder axis.

Figure 4:
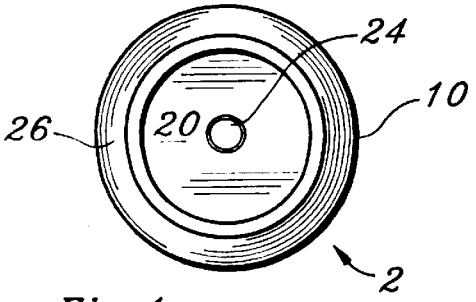
Figure 5:
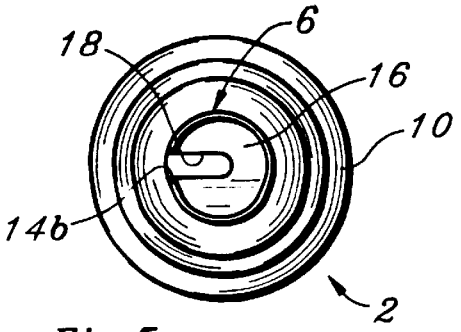

As seen in the top view of FIG. 4, flange 20 is contained in the bottom of an elastomeric cup 10 with threaded member 24 exposed. The cylindrical tee holder 4 extends through a hole in the bottom of cup 10. The elastomeric cup 10 has a circumferential flexible sidewall 26, which is adapted to fit and clasp an ordinary golf club hand grip. The diameter of the threaded member 24 is sized to fit easily within the hole normally found in the end of such a golf club handle.

Figure 6:
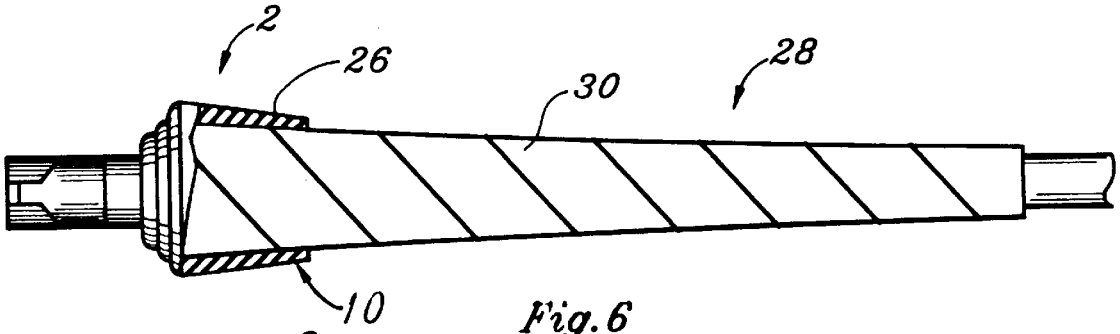
Figure 7:
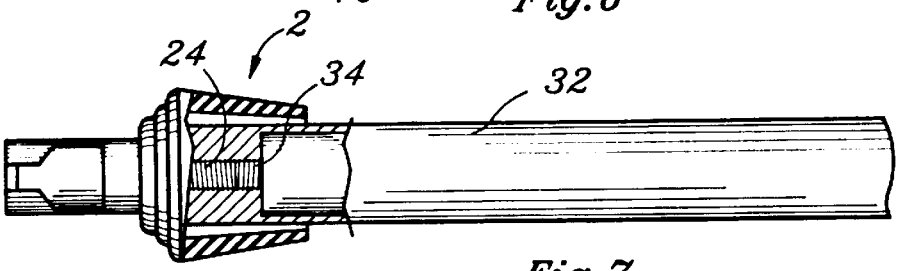

Referring to FIGS. 6 and 7 of the drawing, the golf tee placement and retrieval device 2 is shown in two different modes of use, with two types of elongated members. In FIG. 6, portions of a golf club handle are seen generally at 28 having a hand grip 30. The hand grip end is inserted inside the walls 26 of the elastomeric cup 10, the threaded member 24 extending into the hole in the end of the golf club handle. If the golf club handle has no hole in the end, the threaded member 24 may be removed. The elastomeric cup serves as a temporary attachment means for utilizing a golf club to operate the device.

In FIG. 7, an alternate elongated member comprises a hollow rod 32 with a threaded receptacle 34 at one end thereof. The internal threads of receptacle 34 are adapted to fit the external threads of the threaded member 24 for temporarily attaching the device 2 to the end of the elongated rod 32. In this case, the threaded member 24 acts as a temporary attachment means.

Figure 8:
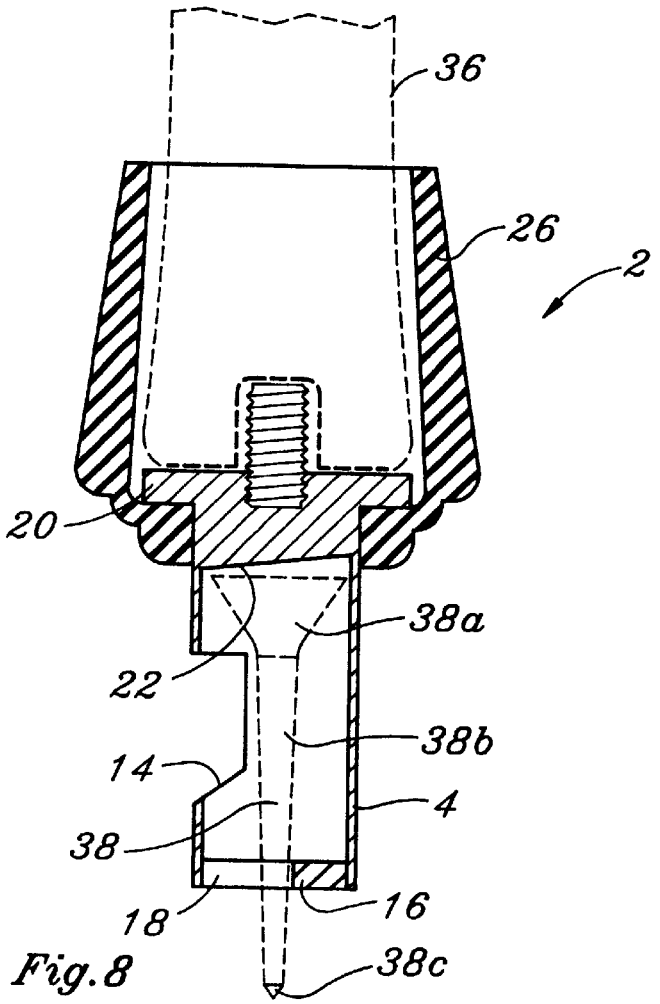

Reference to FIG. 8 of the drawing shows the operation of the preferred embodiment of the invention. Device 2 is shown in cross section, and the outlines of a golf club handle 36 and a golf tee 38 having a circular head 38*a*, tapered shank 38*b* and tip 38*c*, are shown in phantom line. The golf tee placement and retrieval device is placed over the end of the golf club handle 36 with the end thereof resting against the flange 20. The elastomeric walls 26 grip the club handle, retaining the device 2 on the golf club handle. The tee 38 is laterally inserted into the tee container 4 and raised so that its head 38*a* abuts the inclined wall 22. The tee 38 is retained in place by the gripping action of the yieldable sides of slot 18 on the tee retainer. Tip 38*c* of the tee is located and downward force applied on the golf club handle 36 without the necessity of bending or stooping. The downward force exerted is applied to one side of the tee axis due to the shape of pressure member 22. This causes the shank 38*b* of the tee to tend to rotate counterclockwise and move toward the retainer wall 16 and away from the opening 14 where it might become dislodged. Therefore, tee 38 is firmly held as it is inserted into the ground.

To retrieve or move the tee while it is still in the ground, the user merely moves the device laterally so that the tee head enters opening 14. Upward movement of the device causes the tee head 38*a* to lodge against the retainer insert 6 above slot 18 and continued application of upward force withdraws the tee from the ground.

Figure 9:
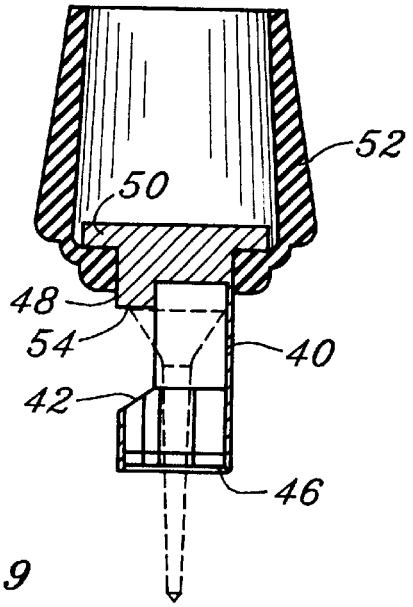
Figure 9A:
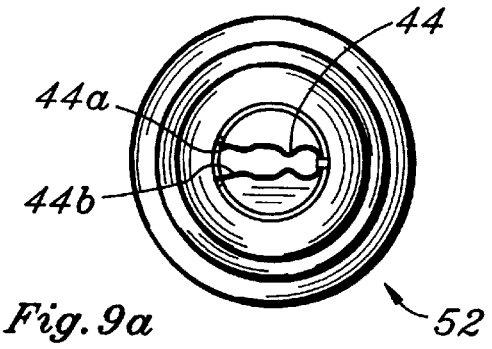

Another embodiment of the invention is shown in FIGS. 9 and 9*a*. A tee container 40 comprises a cylindrical side wall with a cutout 42 providing a tee insertion opening. Rather than an elastomeric tee retainer, a spring clip 44 with two spring fingers 44*a*, 44*b* is supported by attachment 46. On the upper end, a tee driver 48 with flange 50 is held within an elastomeric cup 52. Tee driver 48 includes a pressure member 54 with an abutment extending downwardly and offset from the axis toward the tee insertion opening 42. The operation is as previously described.

The invention permits easily inserting and removing a golf tee without bending or stooping and has no moving parts. It can be carried in the golfer's pocket, in a golf bag or attached to the handle of a spare club.

While there has been described what is considered to be the preferred embodiment of the invention, other modifications will occur to those skilled in the art, and it is desired to secure in the appended claims all such modifications as fall within the true spirit and scope of the invention.

We claim:

1. A golf tee placement and retrieval device for utilization with a separate elongated member and to place and retrieve a golf tee having a circular head, a shank smaller in diameter than the head extending along an axis and a tip, the device comprising:

a tee container having sidewall portions arranged to contain the tee head and a portion of the tee shank, said sidewall portions defining a tee insertion opening for laterally receiving the tee head and shank portion, a tee retainer disposed inside said sidewall portions, and having yieldable portions defining a lateral slot communicating with the tee insertion opening, said lateral slot being of a width such that the yieldable portions yield to laterally receive and grip the tee shank portion to temporarily hold it in place in the tee container, a tee driver comprising a pressure member disposed in the tee container and adapted to apply force to the tee head primarily at a location laterally offset from the tee shank axis on a side thereof toward the tee insertion opening, so as to force the tee shank away from the tee insertion opening as the tip of the tee is inserted, and temporary attachment means connected to the tee container and adapted for connection to the end of an elongated member.

2. The device according to claim 1, wherein the tee container is a cylindrical member.

3. The device according to claim 1, wherein the tee retainer is an elastomeric insert.

4. The device according to claim 1, wherein the tee retainer is a spring clip.

5. The device according to claim 1, wherein the tee driver pressure member defines an inclined surface.

6. The device according the claim 1, wherein the tee driver pressure member is a projecting abutment.

7. The device according to claim 1, wherein the temporary attachment means is an elastomeric cup having a flexible circumferential wall directed away from the tee container.

8. The device according to claim 1, wherein the temporary attachment is a threaded member extending away from the tee container.

9. The device according to claim 8, where the threaded member is also threaded into the tee container so as to be removable.

* * * * *